United States Patent [19]

Parks

[11] Patent Number: 5,061,117

[45] Date of Patent: Oct. 29, 1991

[54] FLUIDIZATION-ASSISTED BEACH STABILIZATION

[76] Inventor: James M. Parks, 3509 Merrick Ct., #210, Lexington, Ky. 40502

[21] Appl. No.: 488,683

[22] Filed: Mar. 5, 1990

[51] Int. Cl.[5] ..... E02B 3/06

[52] U.S. Cl. ..... 405/73; 405/21; 405/52; 405/74

[58] Field of Search ..... 405/73, 74, 52, 15, 405/163, 164, 21, 172; 37/61, 62, 63

[56] References Cited

U.S. PATENT DOCUMENTS

| | | | |
|---|---|---|---|
| 2,718,717 | 9/1955 | Collins | 37/61 |
| 2,961,782 | 11/1960 | Bos | 37/61 |
| 3,013,395 | 12/1961 | Gaylord | 405/74 |
| 3,638,432 | 2/1972 | Schoonmaker | 405/74 |
| 3,695,049 | 10/1972 | Steveninck | 405/163 |
| 3,832,854 | 9/1974 | Metts | 405/74 |
| 3,964,184 | 6/1976 | Mathieu | 37/63 X |
| 4,028,894 | 6/1977 | Larsen | 405/74 |
| 4,645,377 | 2/1987 | Vesterby | 405/74 |
| 4,807,373 | 2/1989 | Sloan et al. | 37/63 |
| 4,898,495 | 2/1990 | Lin | 405/74 X |

*Primary Examiner*—Dennis L. Taylor

*Attorney, Agent, or Firm*—Charles A. McClure

[57] ABSTRACT

Fluidization-assisted beach stabilization. Water is collected from beach-underlying subsoil, and is used to fluidize adjacent off-shore subsoil. More particularly, a first foraminous pipe is buried in beach-underlying subsoil, a second foraminous pipe is buried in adjacent offshore subsoil, such pipes are interconnected, water is collected from the beach subsoil in the first pipe, is transported through the interconnecting pipe to the second pipe, and is jetted from the latter pipe to fluidize the offshore subsoil therewith. Such apparatus and method make more wave-suspended subsoil particles available for deposition onto the beach and for retention thereon.

10 Claims, 1 Drawing Sheet

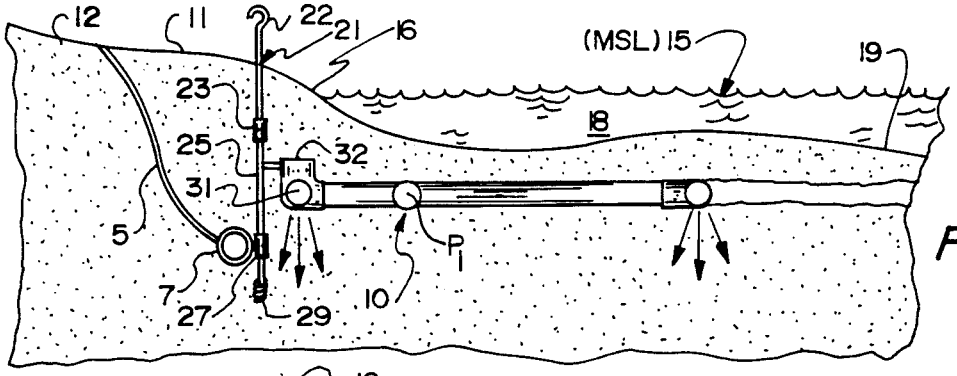
FIG. 1
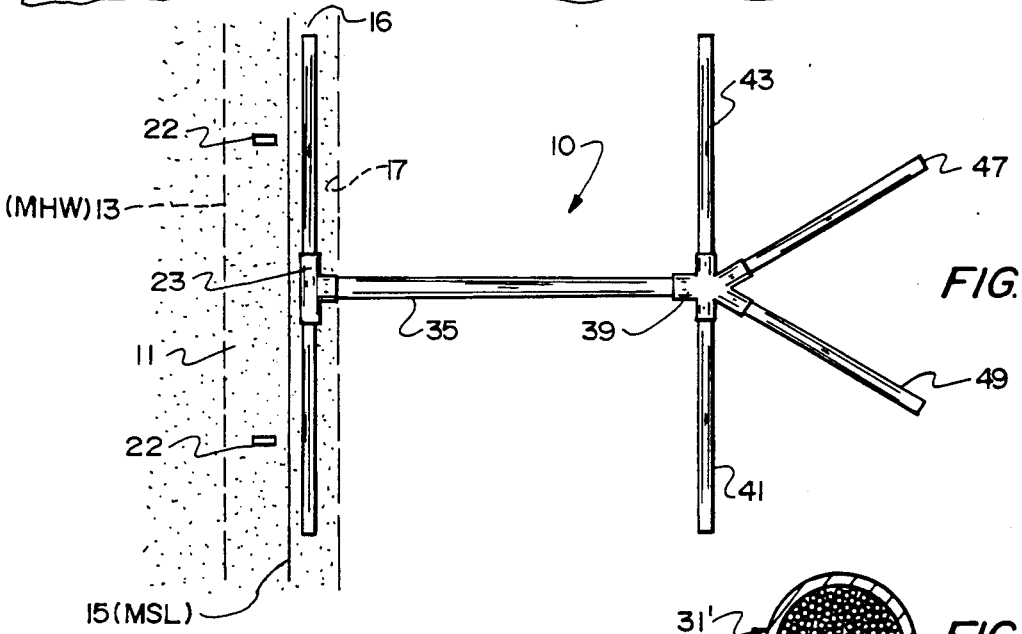
FIG. 2
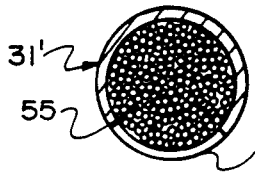
FIG. 5
FIG. 4
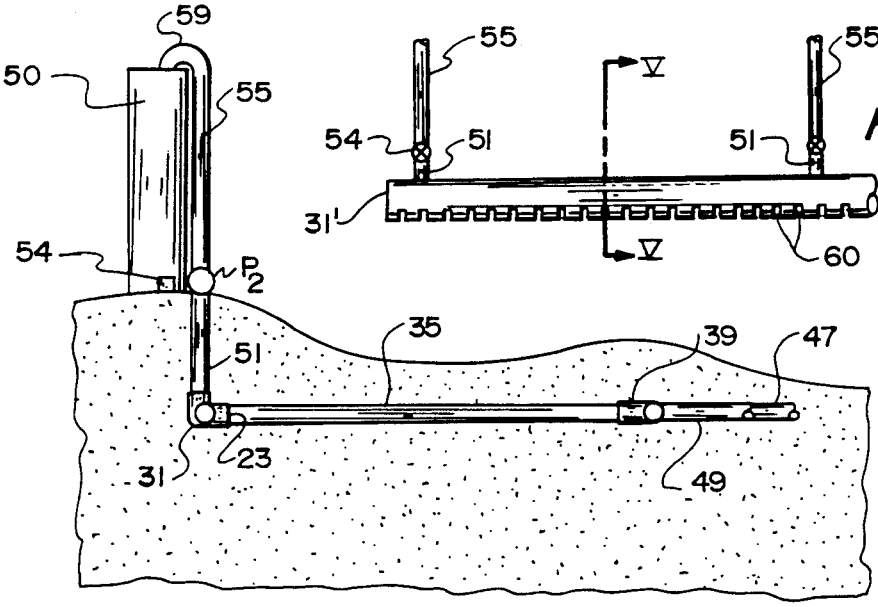
FIG. 3

FLUIDIZATION-ASSISTED BEACH STABILIZATION

TECHNICAL FIELD

This invention relates to stabilization of beaches by localized dewatering, especially as aided by offshore fluidization to increase onshore transport of sand and its retention there by the dewatering.

BACKGROUND OF THE INVENTION

Numerous methods have been suggested and many have been used in an effort to control erosion, and to encourage accretion, of sand and other non-cohesive soils, especially in the instance of beaches—and to discourage deposition of (or to displace) undesired sand or soil, especially in channels useful for shipping. Attempts to overcome undesired effects of wave action or longshore drift, as by construction of groins, jetties, or the like, have usually been unavailing or have produced the opposite of what was sought and/or other deleterious results downdrift therefrom.

Informative articles about beach stabilization include "New Method for Beach Erosion Control" by Machemehl, French, and Huang in *Civil Engineering in the Oceans/III* (1975) 142–160 and "Experimental Control of Beach Face Dynamics by Water-Table Pumping" by Chappell, Eliot, Bradshaw, and Lonsdale in *Engineering Geology,* 14 (1979) 21–40—both of which describe how water withdrawal from subjacent beach sand is conducive to deposition of more sand. Vesterby U.S. Pat. No. 4,645,377 teaches such dewatering just below the mean high water level. A somewhat similar test project has been under way at Sailfish Point near Stuart, Florida since the late summer of 1988, with very promising results. All such methods utilize buried piping.

Channel maintenance (or creation) traditionally is accomplished by dredging, repeated whenever wave action or other currents tend to fill in the channel, which is frequently. Dredging costs enough the first time, and necessary repetition is an aggravation of expense. Fluidization as an alternative to dredging is also well recognized, as by Bruun in "Maintaining Tidal Inlet Channels by Fluidization" *J. Waterway, etc. Engineering* , ASCE, 110(ww4) 117–120; Bruun and Adams in "Stability of Tidal Inlets: Use of Hydraulic Pressure for Channel and Bypassing Stability" *J. Coastal Research* 4 (1988) 687–701; and by the present inventor with others, especially Weisman and Collins, as in "Fluidization as Applied to Sediment Transport (FAST) as an Alternative to Maintenance Dredging of Navigation Channels in Tidal Inlets" *Wastes in the Ocean vol II*: Dredged Material Disposal in the Ocean, Kester et al. (eds.) Wiley (1983).

However, even such alternative channel clearing and maintenance have relied upon the energy-intensive step of dredging to enable the necessary piping to be buried preparatory to fluidizing use. Such gross disturbance of the underwater landscape generates additional undesired shifting of non-cohesive subsoils and must be repeated at frequent intervals as nature undertakes to restore the status quo.

The present inventor follows the precept that man has to learn to use nature rather than to fight it in such environmental efforts.

Pipe placement for dewatering and fluidization is disclosed in the present inventor's copending U.S. patent application Ser. Nos. 345,073 filed 28 Apr. 1989, and 465,838 filed 16 Jan. 1990. The prior art is represented by van Steveninck U.S. Pat. No. 3,695,049, in which piping to be buried is supplied with one or more small accompanying pipes to fluidize underlying subsoil "causing the pipeline together with the fluidization pipes to sink into the fluidized seabed"—on the one hand and, on the other hand—"Pipeline Burial by Fluidization" Paper No. OTC 2276 of OFFSHORE TECHNOLOGY CONFERENCE of the American Institute of Mining, Metallurgical, and Petroleum Engineers at Dallas, Tex. in 1975, wherein a horseshoe-shaped device overlies and straddles piping to be emplaced and fluidizes the adjacent non-cohesive bottom with water jetted from openings in hollow lower stringers of such device, and the piping sags under its weight and the extra weight of the straddling device and sinks into the adjacent fluidized bottom of the subjacent, preferably sandy soil. Clay may interfere with such a goal.

My present invention provides a marriage of onshore dewatering and offshore fluidization, via such piping, for increasing rates of beach accretion and improving the maintenance of existing beaches.

SUMMARY OF THE INVENTION

A primary object of the present invention is to assist nature in accreting and/or maintaining a beach.

Another object is to tip the balance of onrush and backwash of sand-transporting water to and from a beach in favor of depositing a little more than is carried away.

A further object is to use water from beach dewatering to aid in providing additional sand as potential beach accretion component.

In general, the objects of this invention are accomplished, by collecting water from beach-underlying subsoil, and fluidizing adjacent offshore subsoil with such water. More particularly, the invention comprises burying a first foraminous pipe in beach-underlying subsoil, burying a second foramionous pipe in adjacent offshore subsoil, interconnecting the first such pipe to the second such pipe, collecting water from the beach subsoil in the first pipe, transporting such water from the first to the second pipe, and fluidizing offshore subsoil with water from the second pipe. More wave-suspended subsoil particles are made available for deposition onto the beach and retention thereon.

Other objects of the present invention, together with means and methods for attaining the various objects, will be apparent from the following description and accompanying diagrams of preferred embodiments, which are presented by way of example rather that limitation.

SUMMARY OF THE DRAWINGS

FIG. 1 is a side sectional elevation of a beach and adjacent offshore vicinity showing an embodiment of apparatus useful according to this invention;

FIG. 2 is a plan view corresponding to FIG. 1;

FIG. 3 is a side sectional elevation of a variant of FIG. 1;

FIG. 4 is a front elevation of apparatus similarly useful; and

FIG. 5 is a transverse sectional view of apparatus of FIG. 4.

DESCRIPTION OF THE INVENTION

FIGS. 1 and 2 show in side sectional elevation and plan section first embodiment 10 of this invention in a setting featuring beach 11, higher land 12 further onshore, and offshore land 19 under water 18, whose surface is shown temporarily at mean sea level (MSL) 15. AS shown in FIG. 2, MSL 15 is flanked by mean high water line (WHW) 13 on the beach and mean low water line (MLW) 17 on down slope 16.

In FIG. 1, earth anchor 21 in the beach has hook 22 exposed at its top end, helical auger 29 buried at its bottom end, and vertical body portion 25 intervening with most of its length underground. At the left, extending from the beach surface to pipe 9 (retained by sleeve 27 about the body portion near the bottom of the earth auger) is flexible impermeable barrier sheet 5. Retained by similar sleeve 23 about the earth anchor body at a higher level is foraminous pipe 31, which functions as a dewatering pipe as suggested by the arrows pointing radially toward it. Tee 23 (with plug 32 in its top opening) connects to that pipe and to pump P1 between it and pipe 35 interconnecting to more complex fitting 39 from which foraminous pipes 41, 43, 47, and 49 fan out in substantially horizontal directions, 41 and 43 parallel to the beach shore line, and 47 and 49 extending obliquely farther offshore.

FIG. 3 shows another embodiment in which plug 32 in replaced by vertical pipe 51 extending from the top of tee 23 to pump P2 and valve 54 at ground level, joined to connecting pipe 55, which rises alongside standpipe 50 and discharges from outlet 59 at its top end into the top of the standpipe.

FIG. 4 shows in front elevation an embodiment of the foraminous dewatering pipe, here denoted 31', furnished with vertical pipes 51, valves 54, and riser pipes 55 at intervals along its length. Spaced openings (foramina) 60 barely visible in the lower edge of the pipe appear in more detail in the next view.

FIG. 5 shows pipe 31' in transverse section and on an enlarged scale. Opening 60 is seen to be a slot in the lower quadrant of the pipe wall. The pipe itself is filled with aggregate, which not only aids the burial of the pipe but also precludes sand from entering it and possibly getting carried by water flow to the pump (not shown).

Operation of the described apparatus of this invention to practice the method of the invention is readily apparent from the foregoing description and the accompanying diagrams. An equilibrium of subsoil (such as sand) transport onto the beach and then off or away from the beach normally prevails, but in abnormal conditions, such as storms, more sand may be removed from the beach than is deposited thereonto. What the present invention does is to tip the equilibrium enough so that more sand is deposited onshore than is removed in unfavarable conditions, or at least to preclude excessive losses of beach sand.

In the first embodiment, water from waves rushing onto the beach seeps down into the subsoil and into the foraminous dewatering pipe buried under the beach (through its many openings). Water so collected is pumped offshore via an interconnecting pipe and into the foraminous fluidizing pipes, from which it is injected into the adjacent non-cohesive subsoil, fluidizing it. The fluidized subsoil is carried by water currents and wave action alongshore and onto shore, where the increased concentraion of fluidized subsoil leaves a bit more than normally remains on the beach as the dewatering pipe increases drainage of the water beyond what would normally seep into the beach soil. Thus, the apparatus and method of this invention have tipped the equilibrium in favor of beach accretion, and a few thousand waves a day will do the rest of the desired Herculean task. Use of an impermeable sheetlike barrier, to preclude draining water from further onshore, renders the process more productive, as well as conserving the onshore moisture, as is generally desirable.

In the next embodiment, instead of—or in addition to—pumping the collected water directly to the fluidizing piping, the water is pumped at a relatively slow rate into storage, from which it can be retrieved rapidly by gravity flow, as when a storm may have shifted the equilibrium away from 50/50 toward removing too much sand from the beach, or alternatively whenever conditions favor accretion and fluidization will accelerate that desired process. Again, as nature provides most of the water movement and sand suspension, only enough water need be pumped to tip the equilibrium, rather than doing all the work, as is attempted when beach inhabitants resort to dredging. Of course, the impermeable barrier is useful in this method as well.

Preferred embodiments and variants have been suggested for this invention. Other modifications may be made, as by adding, combining, deleting, or subdividing compositions, parts or steps, while retaining all or some of the advantages and benefits of the present invention—which itself is defined in the following claims.

The invention claimed is:

1. Method of improving a beach, comprising the steps of burying foraminous piping in beach-underlying subsoil, burying foraminous piping in offshore-underlying subsoil, interconnecting the beach-underlying piping to the offshore-underlying piping with intermediate piping containing a pump, collecting water from the beach-underlying subsoil via the first piping, transporting the collected water via the intermediate piping to the offshore-underlying second piping, and fluidizing adjacent offshore subsoil with such water for transport elsewhere.

2. Beach-improvement method according to claim 1, including barring water collection from subjacent soil further inland.

3. Beach-improvement method according to claim 1, including so piping more water the stronger the contemporaneous was action onto the beach.

4. Beach-improvement method according to claim 1, including storing some of the water so collected for such use in the future.

5. Method of improving a beach, comprising the steps of burying a first foraminous pipe in beach-underlying subsoil, burying a second foraminous pipe in adjacent offshore subsoil, interconnecting the first such pipe to the second such pipe, collecting water from the beach subsoil in the first pipe, transporting such water from the first to the second pipe, and fluidizing offshore subsoil with water from, the second pipe for transport elsewhere.

6. Beach-improvement method according to claim 5, including storing at least some of the collected water in a standpipe.

7. Beach-improvement method according to claim 5, including pumping some collected water continuously into such standpipe so long as the standpipe is not filled.

8. Beach-improvement method according to claim 5, including drawing more water down from the standpipe the stronger the contemporaneous was action onto the beach.

9. Combined onshore-dewatering and offshore-fluidizing apparatus conducive to beach improvement, comprising a first foraminous pipe buried in beach-underlying subsoil and adapted to collect water from adjacent subsoil thereinto, a second foraminous pipe buried in adjacent offshore subsoil and adapted to inject water into adjacent subsoil to fluidize it, an interconnecting pipe between the first and second pipes, and means transporting such water through the interconnecting pipe.

10. Apparatus according to claim 9, wherein the transporting means includes a standpipe connected to the second foraminous pipe.

* * * * *